US010252516B2

(12) United States Patent
Sugimoto et al.

(10) Patent No.: US 10,252,516 B2
(45) Date of Patent: Apr. 9, 2019

(54) PRINTING APPARATUS, LIQUID ABSORBING APPARATUS, AND METHOD

(71) Applicant: CANON KABUSHIKI KAISHA, Tokyo (JP)

(72) Inventors: Masahiro Sugimoto, Yokohama (JP); Yuichiro Yanagi, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/910,444

(22) Filed: Mar. 2, 2018

(65) Prior Publication Data

US 2018/0257412 A1 Sep. 13, 2018

(30) Foreign Application Priority Data

Mar. 13, 2017 (JP) ..... 2017-047490

(51) Int. Cl.
*B41J 2/01* (2006.01)
*B41J 2/005* (2006.01)

(52) U.S. Cl.
CPC ..... *B41J 2/0057* (2013.01); *B41J 2/01* (2013.01); *B41J 2002/012* (2013.01)

(58) Field of Classification Search
CPC ..... B41J 2/0057; B41J 2002/012
See application file for complete search history.

(56) References Cited

U.S. PATENT DOCUMENTS 6,682,189 B2 1/2004 May et al.
6,767,092 B2 7/2004 May et al.
8,641,165 B2 2/2014 Shimizu et al.
9,321,268 B1 4/2016 Thayer et al.
2004/0036758 A1* 2/2004 Sasaki ..... B41J 2/0057 347/154

FOREIGN PATENT DOCUMENTS

EP 0 530 627 A2 3/1993
EP 3 115 209 A2 1/2017
JP 2003-182064 A 7/2003
JP 2011-073143 A 4/2011

OTHER PUBLICATIONS

U.S. Appl. No. 15/920,479, Yuichiro Yanagi Masahiro Sugimoto, filed Mar. 14, 2018.
U.S. Appl. No. 15/920,838, Yuichiro Yanagi Masahiro Sugimoto, filed Mar. 14, 2018.
Extended European Search Report dated Oct. 2, 2018, in European Patent Application No. 18000117.4.

* cited by examiner

*Primary Examiner* — Julian D Huffman
(74) *Attorney, Agent, or Firm* — Venable LLP

(57) ABSTRACT

A printing apparatus includes a transfer drum including a transfer section and a non-transfer section which are moved cyclically, a print unit forming an ink image by discharging ink to the transfer section, a transfer unit transferring the ink image to a print medium, liquid absorbing member absorbing a liquid component from the ink image on the transfer section, a driving unit moving the liquid absorbing member, and a control unit. When a position at which the liquid absorbing member absorbs the liquid component from the ink image on the transfer section is defined as a liquid absorbing position, the control unit controls the driving unit such that a predetermined portion in which liquid absorbing performance of the liquid absorbing member degrades passes through the liquid absorbing position while the non-transfer section passes through the liquid absorbing position.

14 Claims, 19 Drawing Sheets

PRINTING APPARATUS, LIQUID ABSORBING APPARATUS, AND METHOD

BACKGROUND OF THE INVENTION

Field of the Invention

The present invention relates to a transfer type printing technique.

Description of the Related Art

A technique of forming an ink image on a transfer member and transferring it to a print medium such as paper is proposed. For example, Japanese Patent Laid-Open No. 2003-182064 discloses an image forming apparatus configured to form an ink image on an intermediate member and transfer the ink image to a sheet. This apparatus includes an inkjet device that forms a primary image on the intermediate member. This apparatus also includes a zone where an aggregate is formed in the primary image, a zone where a liquid is partially removed from the aggregate, a zone where an image is transferred to a sheet, and a zone where the surface of the intermediate member is reproduced before a new primary image is formed. Japanese Patent Laid-Open No. 2011-73143 points out an influence on conveyance accuracy given by a connecting portion (seam) of an endless belt in a belt conveyance mechanism.

When a member with a part different in characteristic from another part such as the connecting portion of the endless belt is used as a liquid absorbing member that absorbs a liquid component of the ink image, absorption of the liquid component may vary among portions of the liquid absorbing member. If the liquid component of the ink image is removed insufficiently, or a portion with insufficient removal of the liquid component exists in a part of the ink image, that influences the quality of an image to be formed.

SUMMARY OF THE INVENTION

The present invention provides a technique of reducing a variation in absorption of a liquid component by a liquid absorbing member.

According to an aspect of the present invention, there is provided a printing apparatus comprising: a transfer drum that includes a transfer section and a non-transfer section which are moved cyclically; a print unit configured to form an ink image by discharging ink to the transfer section; a transfer unit configured to perform a transfer operation of transferring the ink image formed on the transfer section to a print medium; a liquid absorbing member configured to absorb a liquid component from the ink image on the transfer section before the transfer operation is performed; a driving unit configured to move the liquid absorbing member; and a control unit configured to control the driving unit such that, when a position at which the liquid absorbing member absorbs the liquid component from the ink image on the transfer section is defined as a liquid absorbing position, a predetermined portion in which liquid absorbing performance of the liquid absorbing member degrades passes through the liquid absorbing position while the non-transfer section passes through the liquid absorbing position.

Further features of the present invention will become apparent from the following description of exemplary embodiments (with reference to the attached drawings).

DESCRIPTION OF THE EMBODIMENTS

Embodiments of the present invention will be described with reference to the accompanying drawings. In each view, arrows X and Y indicate horizontal directions perpendicular to each other. An arrow Z indicates a vertical direction.

<Printing System>

Figure 1:
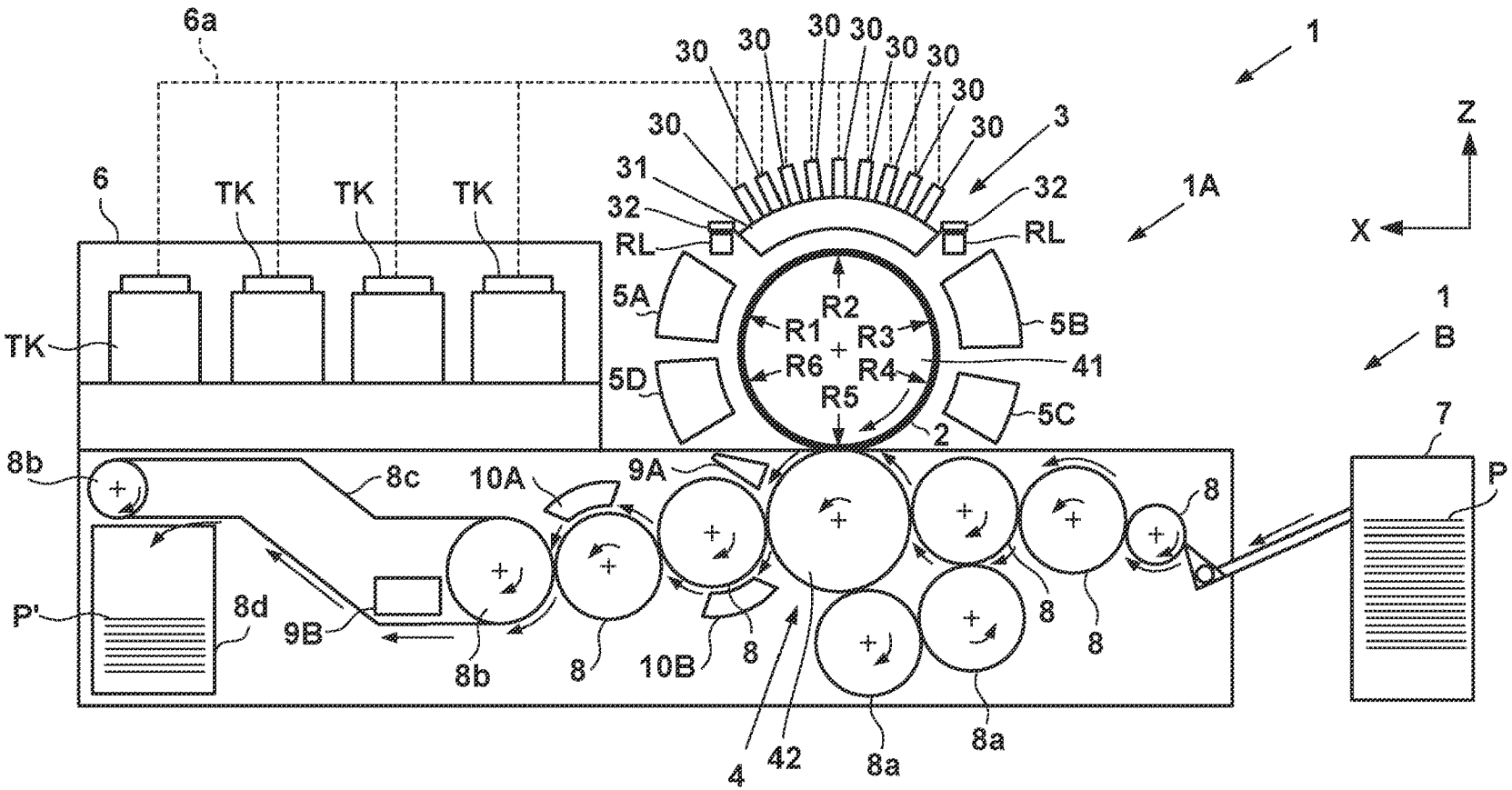
FIG. 1 is a schematic view showing a printing system.

FIG. 1 is a front view schematically showing a printing system (printing apparatus) 1 according to an embodiment of the present invention. The printing system 1 is a sheet inkjet printer that forms (manufactures) a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

Note that "print" includes not only formation of significant information such as a character or graphic pattern but also formation of an image, design, or pattern on print media in a broader sense or processing of print media regardless of whether the information is significant or insignificant or has become obvious to allow human visual perception. In this embodiment, "print media" are assumed to be paper sheets but may be fabrics, plastic films, and the like.

An ink component is not particularly limited. In this embodiment, however, a case is assumed in which aqueous pigment ink that includes a pigment as a coloring material, water, and a resin is used.

<Printing Apparatus>

The printing apparatus 1A includes a print unit 3, a transfer unit 4, peripheral units 5A to 5D, and a supply unit 6.

<Print Unit>

Figure 2:
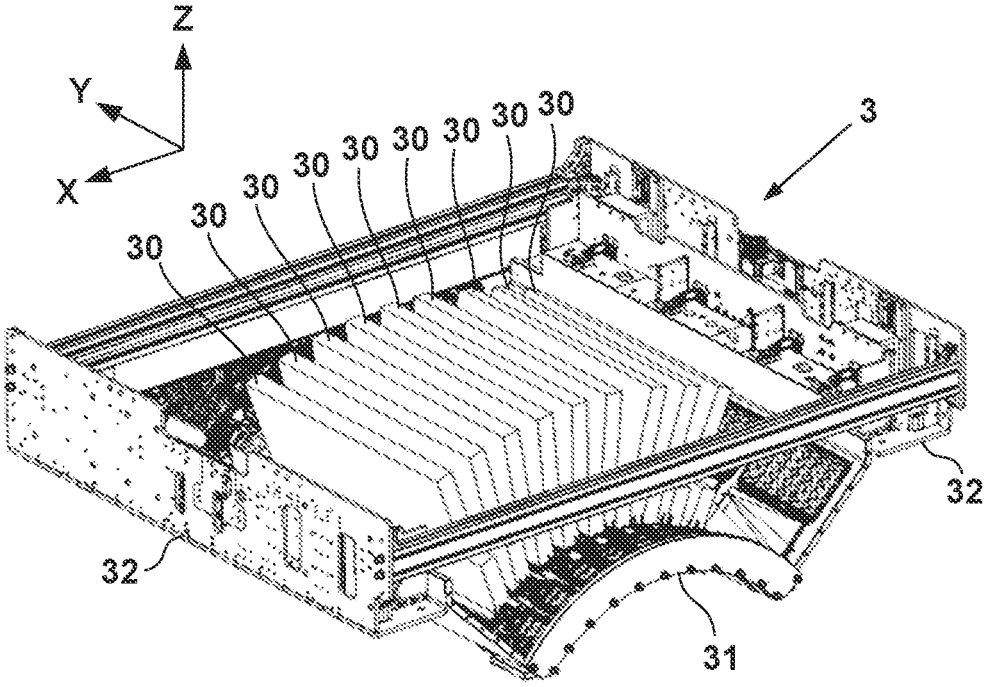
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
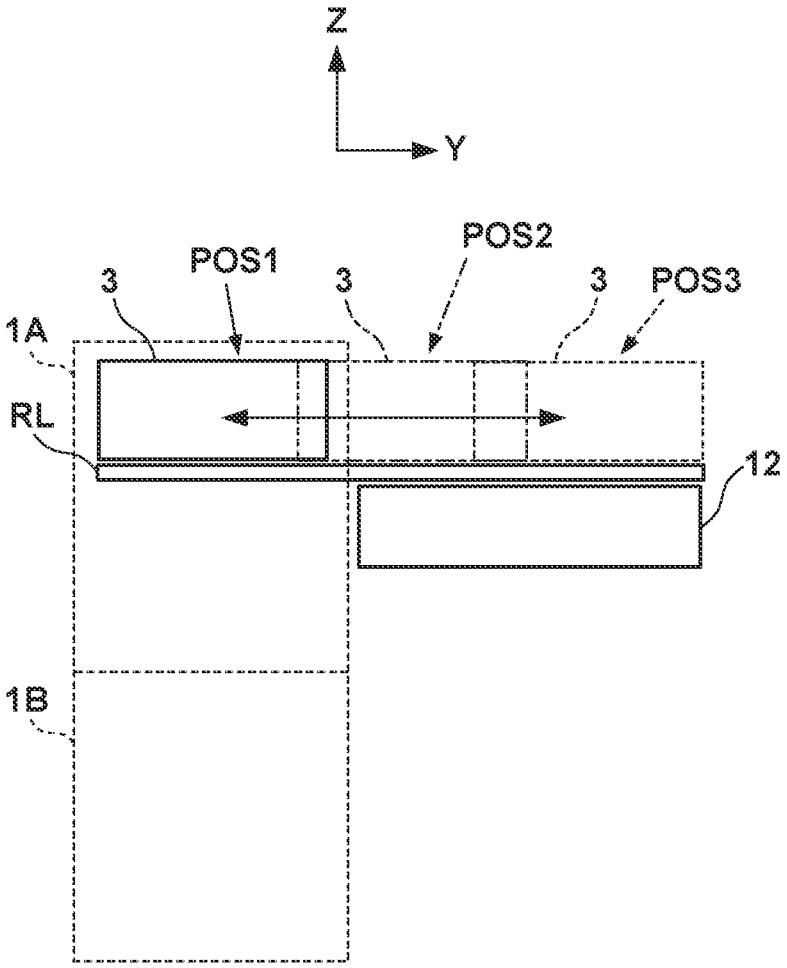
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, a suction mechanism which sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum (transfer cylinder) 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends dividedly into a plurality of segments. The respective segments can be arranged in an arc at an equal pitch on the outer peripheral surface of the transfer drum 41.

The transfer member 2 moves cyclically on the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials such as a resin and a ceramic can be used appropriately. In respect of durability or the like, however, a material high in compressive modulus can be used. More specifically, an acrylic resin, an acrylic silicone resin, a fluoride-containing resin, a condensate obtained by condensing a hydrolyzable organosilicon compound, and the like can be given. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like can be given as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials such as the resin and the ceramic can be used appropriately. In respect of processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like can be given. In addition, ethylene propylene rubber, natural rubber, styrene rubber, isoprene rubber, butadiene rubber, the copolymer of ethylene/propylene/butadiene, nitrile-butadiene rubber, and the like can be given. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 can share a driving source such as a motor that drives them, and a driving force can be delivered by a transmission mechanism such as a gear mechanism.

<Peripheral Unit>

The peripheral units 5A to 5D are arranged around the transfer drum 41. In this embodiment, the peripheral units 5A to 5D are specifically an application unit, an absorption unit, a heating unit, and a cleaning unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

As described above, in this embodiment, the application unit 5A, the absorption unit 5B, the heating unit 5C, and the cleaning unit 5D are included as the peripheral units. However, cooling functions of the transfer member 2 may be applied, or cooling units may be added to these units. In this embodiment, the temperature of the transfer member 2 may be increased by heat of the heating unit 5C. If the ink image exceeds the boiling point of water as a prime solvent of ink after the print unit 3 discharges ink to the transfer member 2, performance of liquid component absorption by the absorption unit 5B may be degraded. It is possible to maintain the performance of liquid component absorption by cooling the transfer member 2 such that the temperature of the discharged ink is maintained below the boiling point of water.

The cooling unit may be an air blowing mechanism which blows air to the transfer member 2, or a mechanism which brings a member (for example, a roller) into contact with the transfer member 2 and cools this member by air-cooling or water-cooling. The cooling unit may be a mechanism which cools the cleaning member of the cleaning unit 5D. A cooling timing may be a period before application of the reactive liquid after transfer.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side but transferred to the conveyance drums 8*a* from the pressurizing drum 42 after transfer onto the surface. The print medium P is reversed via the two conveyance drums 8*a* and transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, glossy, and the like of an image on the image printed surface of the printed product P'. For example, liquid application, sheet welding, lamination, and the like can be given as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint or the like of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
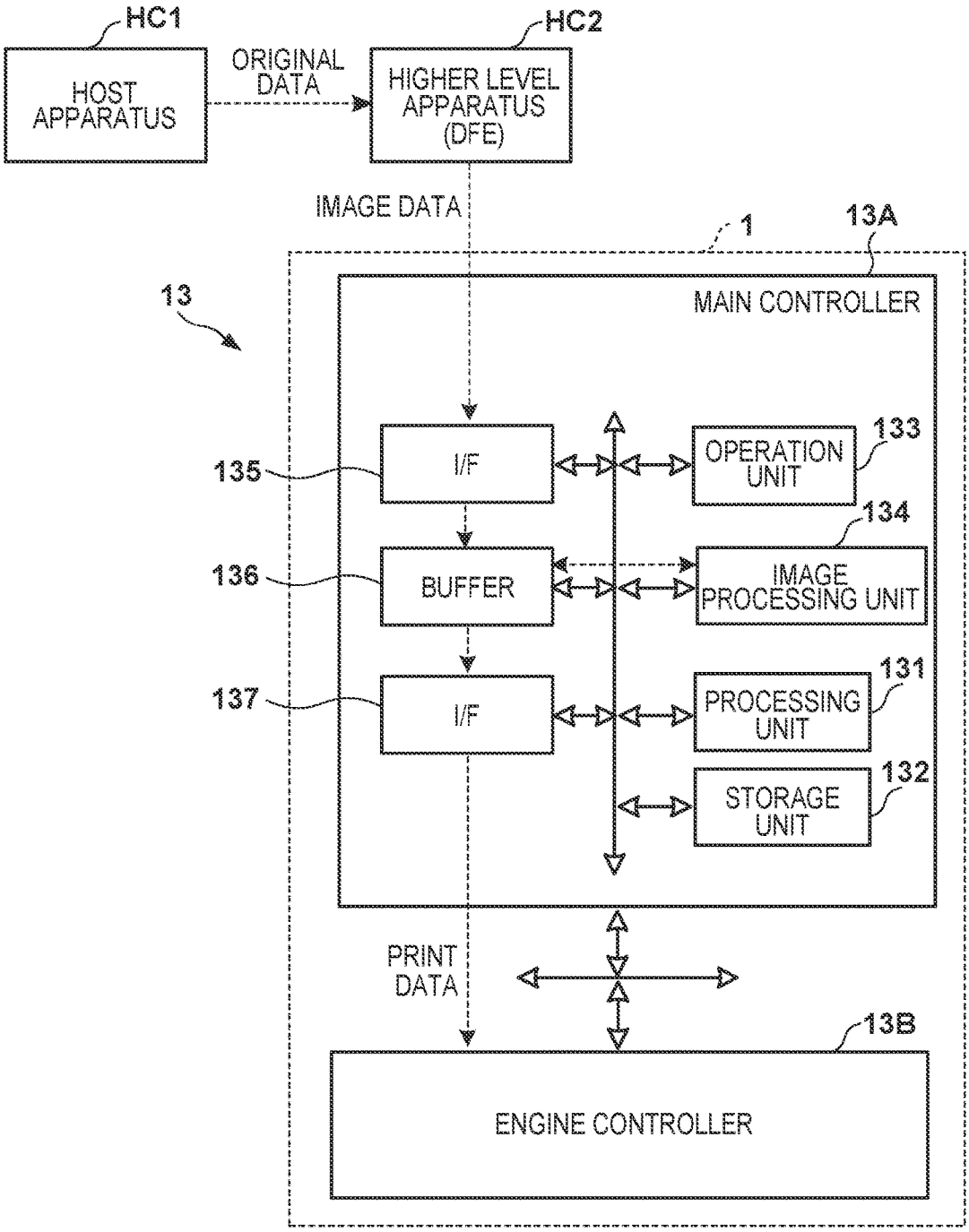
FIG. 4 is a block diagram showing a control system of the printing system in FIG. 1.
Figure 5:
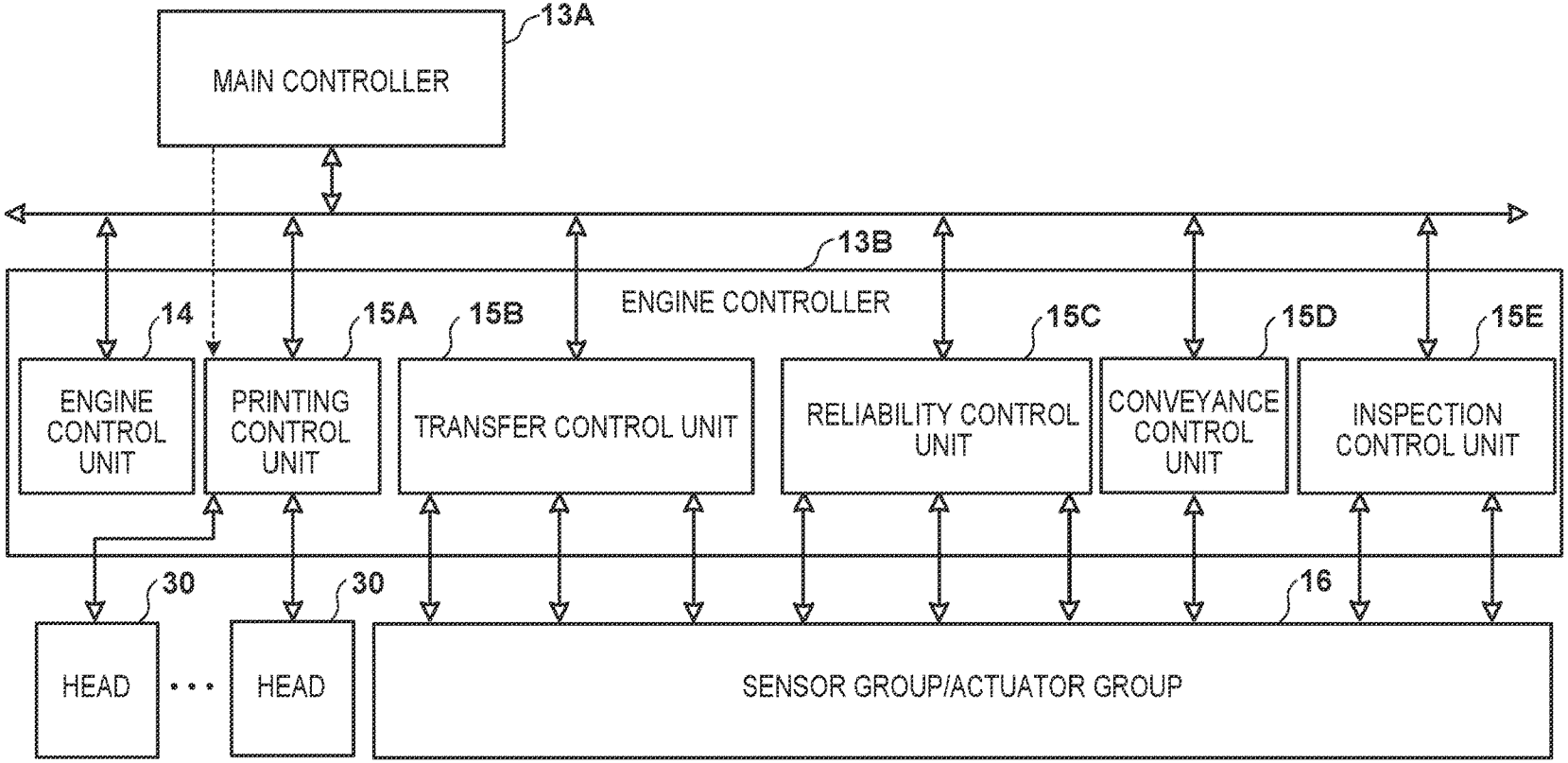
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. The operation unit 133 is, for example, an input device such as a touch panel, a keyboard, or a mouse and accepts a user instruction.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes control units 14 and 15A to 15E, and obtains a detection result of a sensor group/actuator group 16 of the printing system 1 and controls driving of the groups. Each of these control units includes a processor such as a CPU, a storage device such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

OPERATION EXAMPLE

Figure 6:
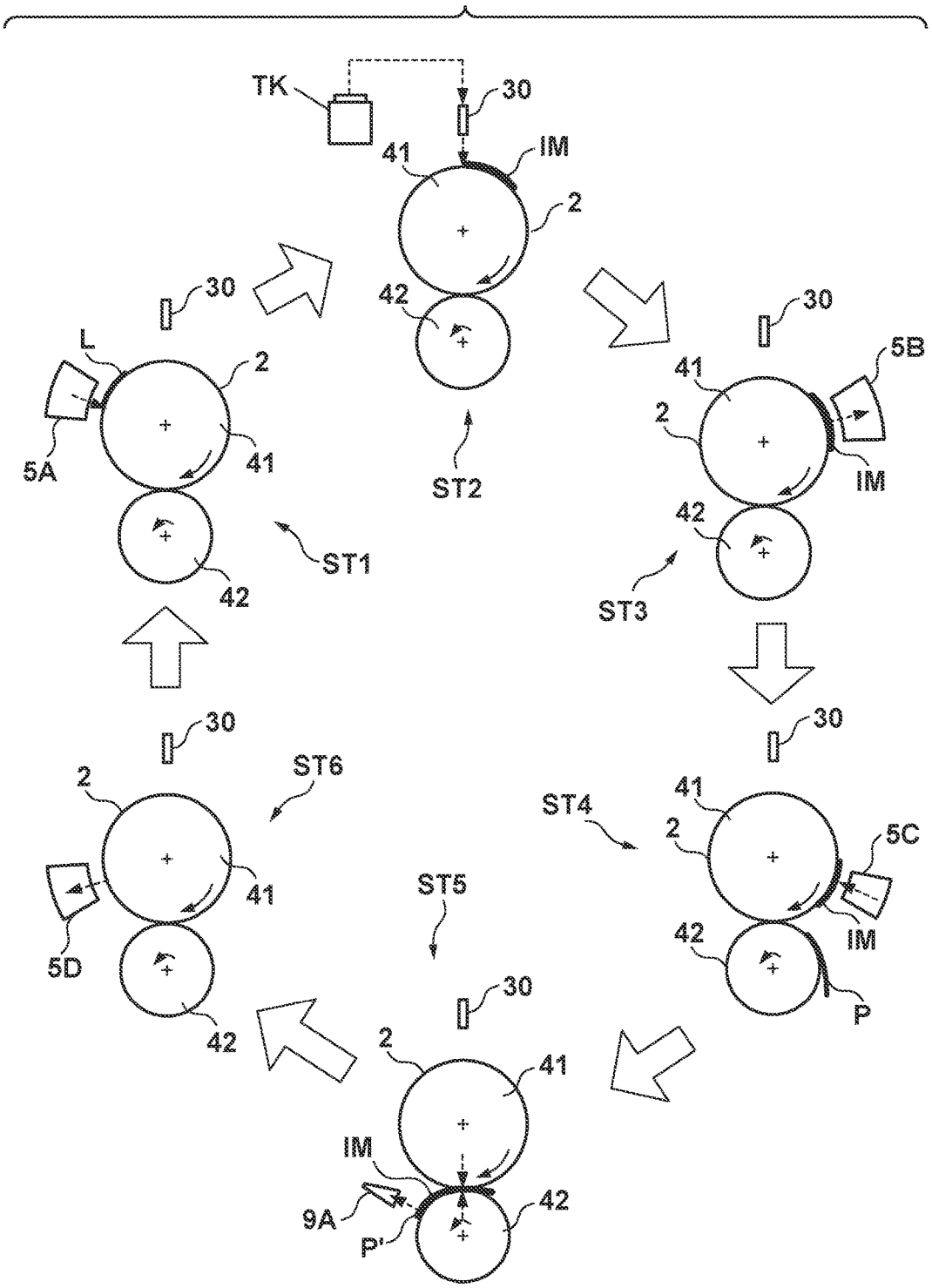
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Figure 7:
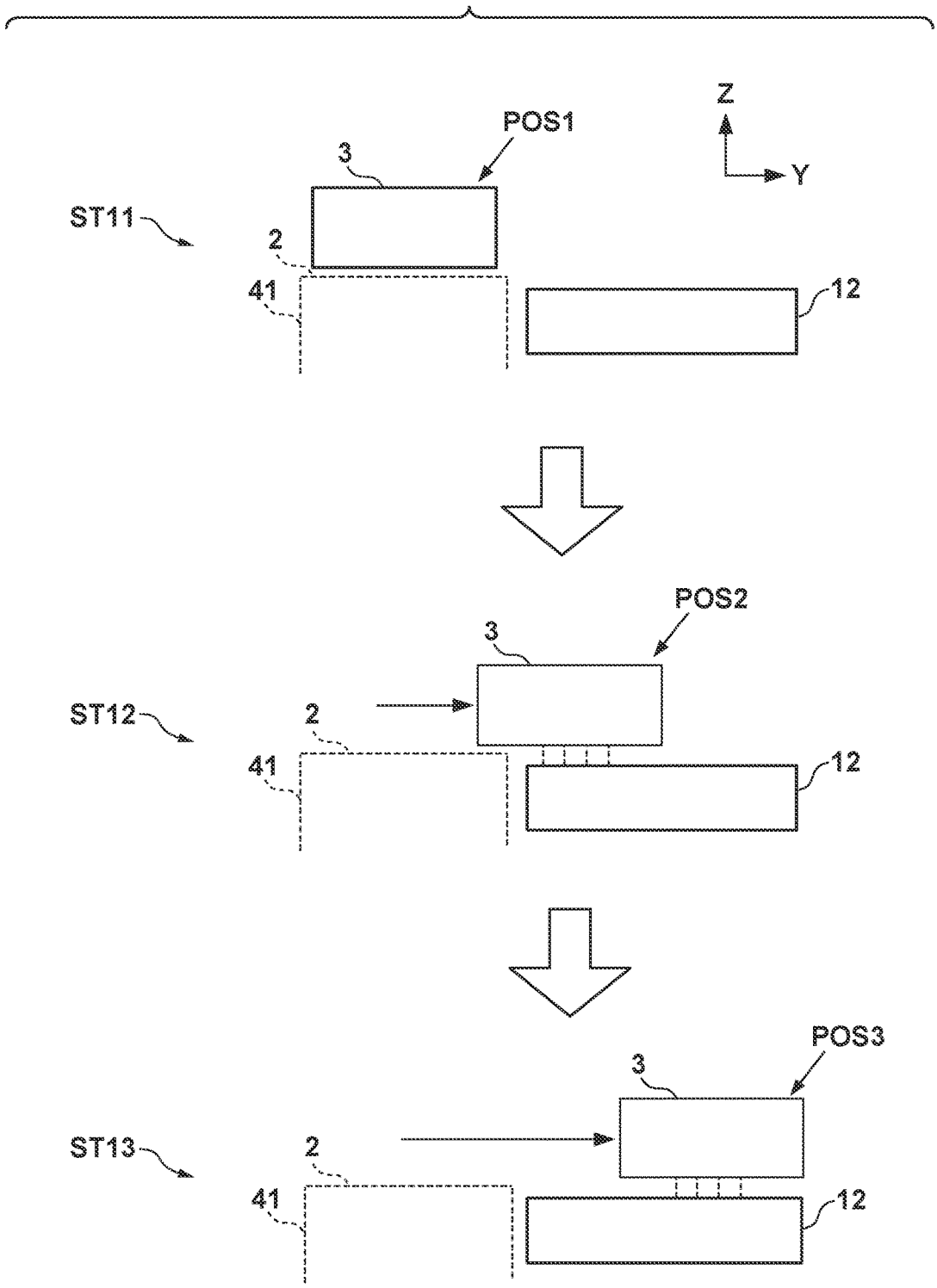
FIG. 7 is an explanatory view showing an example of the operation of the printing system in FIG. 1.

Each printhead 30 needs maintenance if such a printing operation continues. FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

<Absorption Unit>

Figure 8:
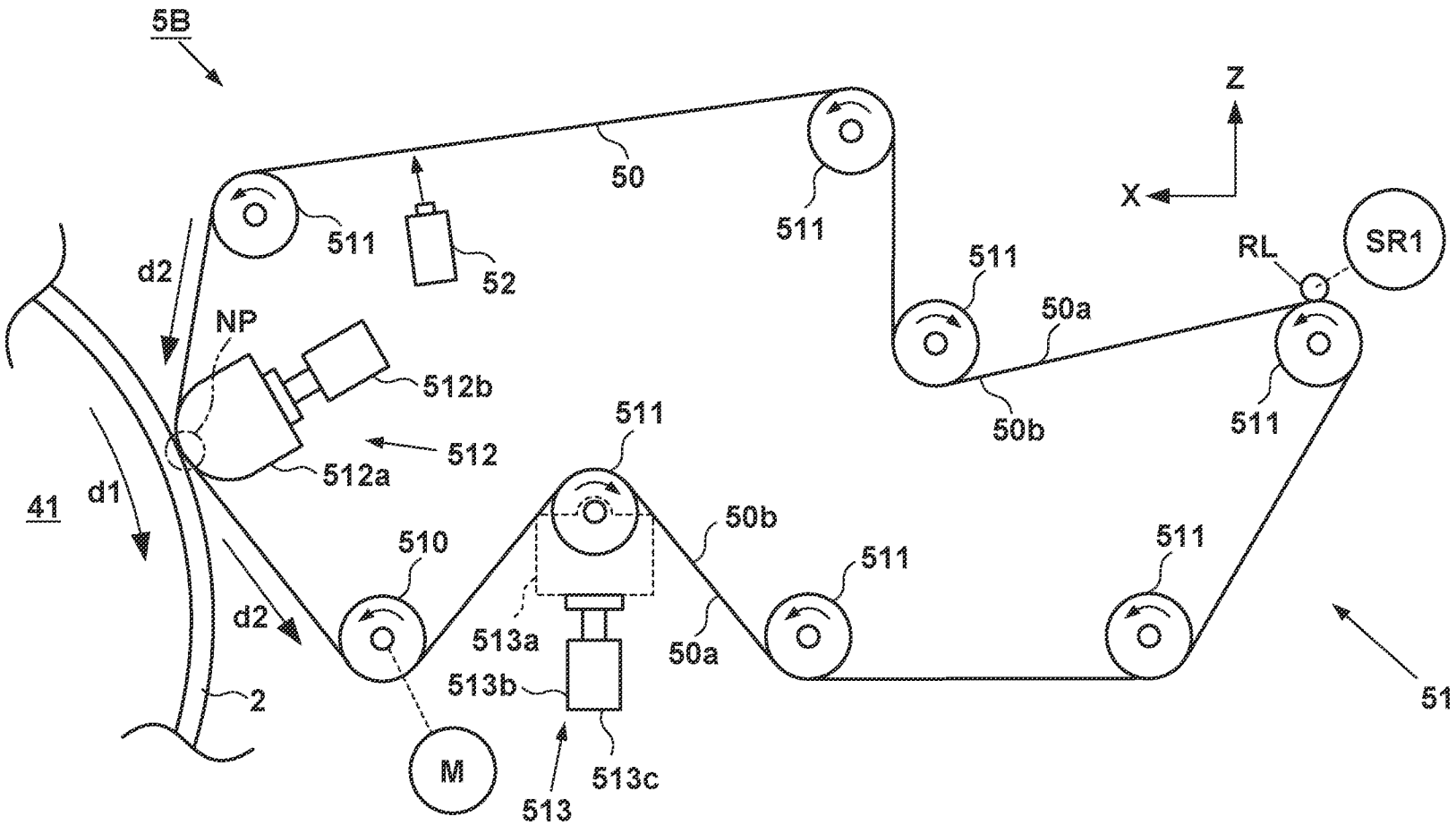
FIG. 8 is a schematic view showing an absorption unit.

A detailed example of the absorption unit 5B will be described with reference to FIG. 8. FIG. 8 is a schematic view showing an example of the absorption unit 5B. The absorption unit 5B is a liquid absorbing apparatus that absorbs a liquid component from the ink image IM formed on the transfer member 2 before the ink image IM is transferred to the print medium P. When the aqueous pigment ink is used as in this embodiment, the absorption unit 5B mainly aims at absorbing water in the ink image. This makes it possible to suppress occurrence of a curl or cockling of the print medium P.

The absorption unit 5B includes a liquid absorbing member 50, a driving unit 51 that cyclically moves the liquid absorbing member 50, and a detection unit 52.

The liquid absorbing member 50 is an absorber that absorbs the liquid component from the ink image IM and is formed into a sheet-type endless belt in the example of FIG. 8. A liquid absorbing position NP is a position where the liquid absorbing member 50 absorbs the liquid component from the ink image IM on the transfer member 2 and indicates a portion where the liquid absorbing member 50 gets closest to the transfer member 2. An arrow d1 indicates a moving direction of the transfer member 2, and an arrow d2 indicates a moving direction of the liquid absorbing member 50.

The liquid absorbing member 50 may be formed by a single layer but may be formed by a plurality of layers. A two-layered structure of an obverse layer and a reverse layer is exemplified here. The obverse layer forms a surface 50*a* contacting the ink image IM, and the reverse layer forms an opposite surface 50*b*. The liquid absorbing member 50 absorbs the liquid component of the ink image IM on the transfer member 2. The liquid component of the ink image IM penetrates from the obverse layer to the liquid absorbing member 50 and further penetrates to the reverse layer. The ink image IM is changed to an ink image IM' with a decreased liquid component and moves toward the heating unit 5C.

Each of the obverse layer and the reverse layer can be made of a porous material. The average pore size of the obverse layer can be made smaller than that of the reverse layer in that performance of liquid component absorption is increased while suppressing adherence of the coloring material.

A material for the obverse layer may be, for example, a hydrophilic material whose contact angle with respect to water is less than 90° or a water-repellent material whose contact angle with respect to water is 90° or more. For the hydrophilic material, the material may have the contact angle with respect to water to be 40° or less. The contact angle may be measured complying with a technique described in, for example, "6. static method" of JIS R3257.

The hydrophilic material has an effect of drawing up a liquid by a capillary force. Cellulose, polyacrylamide, or a composite material of these can be given as the hydrophilic material. When the water-repellent material is used, a hydrophilic treatment may be performed on its surface. A method such as sputter etching can be given as the hydrophilic treatment.

For example, a fluorine resin can be given as the water-repellent material. For example, polytetrafluoroethylene, polychlorotrifluoroethylene, polyvinylidene fluoride, or the like can be given as the fluorine resin. A time may be taken until the effect of drawing up the liquid is achieved when the water-repellent material is used for the obverse layer. To cope with this, a liquid whose contact angle with the obverse layer is less than 90° may be impregnated into the obverse layer.

For example, resin-fiber nonwoven fabric or woven fabric can be given as a material for the reverse layer. The material for the reverse layer may have the contact angle of water equal to or larger than that for the obverse layer because the liquid component does not flow backward from the reverse layer to the obverse layer. For example, polyolefin, polyurethane, polyamide such as nylon, polyester, polysulfone, or a composite material of these can be given as the material for the reverse layer.

For example, adhesive lamination, thermal lamination, or the like can be given as an accumulative method of the obverse layer and the reverse layer.

The driving unit 51 is a mechanism which supports the liquid absorbing member 50 such that it can run cyclically so as to pass through the liquid absorbing position NP and includes a driving rotating body 510, a plurality of driven rotating bodies 511, and a position adjustment mechanism 512. The driving rotating body 510 and the driven rotating bodies 511 are rollers or pulleys around which the swath liquid absorbing member 50 is wound and are rotatably supported about a rotation axis in the Y direction.

The driving rotating body 510 rotates by a driving force of a motor M and runs the liquid absorbing member 50. The driven rotating bodies 511 are supported freely rotatably. In this embodiment, seven driven rotating bodies 511 are provided, and these driven rotating bodies 511 and the driving rotating body 510 delimit a moving path (running track) of the liquid absorbing member 50. The moving path of the liquid absorbing member 50 is a zigzag path winding up and down when viewed from a running direction (arrow d2). This makes it possible to use the longer liquid absorbing member 50 in a smaller space and decrease a replacement frequency upon degradation in performance of the liquid absorbing member 50.

One of the plurality of driven rotating bodies 511 includes a tension adjustment mechanism 513. The tension adjustment mechanism 513 is a mechanism which adjusts the tension of the liquid absorbing member 50 and includes a support member 513*a*, a moving mechanism 513*b*, and a sensor 513*c*. The support member 513*a* supports the driven rotating body 511 rotatably about the rotation axis in the Y direction. The moving mechanism 513*b* is a mechanism which moves the support member 513*a* and is, for example, an electric cylinder. The moving mechanism 513*b* can displace the driven rotating body 511, adjusting the tension of the liquid absorbing member 50. The sensor 513*c* detects the tension of the liquid absorbing member 50. In this embodiment, the sensor 513*c* detects a load received by the moving mechanism 513*b*. The tension of the liquid absorbing member 50 can be controlled automatically by controlling the moving mechanism 513*b* based on a detection result of the sensor 513*c*.

The position adjustment mechanism 512 includes a movable member 512*a* and a pressing mechanism 512*b*. The movable member 512*a* is arranged facing the transfer member 2 and has a peripheral surface where the liquid absorbing member 50 slides. The pressing mechanism 512*b* is a mechanism which moves the movable member 512*a* back and forth to the side of the transfer member 2, and is, for example, an electric cylinder but may be an elastic member such as a coil spring. The liquid absorbing member 50 is brought into contact with the transfer member 2 or maintained at a position an infinitesimal distance away from the surface by the position adjustment mechanism 512 and absorbs the liquid component from the ink image IM formed on the transfer member 2 before the transfer.

A sensor SR1 detects a moving velocity (running velocity) or moving amount (running amount) of the liquid absorbing member 50. The sensor SR1 is, for example, a rotary encoder. In this embodiment, a rotating body RL of the sensor SR1 contacts the liquid absorbing member 50, rotates in accordance with running of the liquid absorbing member 50, and detects its rotation amount. The rotating body RL is arranged facing the driven rotating bodies 511. It is also possible to detect the running velocity or running amount of the liquid absorbing member 50 by detecting the rotation velocities of the driven rotating bodies 511 and the driving rotating body 510. However, the liquid absorbing member 50 may slip with respect to them. As in this embodiment, it is possible to improve detection accuracy by detecting the running velocity of the liquid absorbing member 50 directly with the sensor SR1.

The detection unit 52 is a sensor that detects passage of a predetermined portion of the liquid absorbing member 50 at a predetermined position on the moving path of the liquid absorbing member 50. In this embodiment, the detection unit 52 is arranged at a position comparatively near the liquid absorbing position NP. In one round of the moving path of the liquid absorbing member 50 with the liquid absorbing position NP as a starting point and an ending point, the position of the detection unit 52 can be a position on a side closer to the ending point than a halfway point or a position on a side closer to the ending point than a halfway point between the halfway point and the ending point.

Figure 9A:
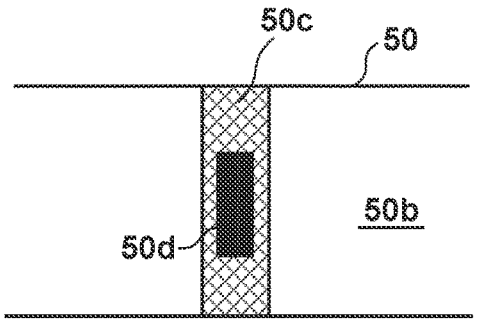
FIGS. 9A and 9B are views each showing an example of a marker.

In this embodiment, the detection unit 52 detects the connecting portion of the liquid absorbing member 50 as a predetermined portion. FIG. 9A is an explanatory view of this. In this embodiment, the liquid absorbing member 50 is formed into an endless belt by connecting the two end portions of a belt material. FIG. 9A shows its connecting portion 50*c*. In this embodiment, a marker 50*d* indicating a position of the connecting portion 50*c* is provided on the reverse surface 50*b* of the liquid absorbing member 50. The detection unit 52 may be a sensor that identifies the connecting portion 50*c*. In this embodiment, however, the detection unit 52 detects the connecting portion 50*c* by detecting the marker 50*d*. The marker 50*d* is, for example, a marker different in color from another portion of the liquid absorbing member 50 (for example, the liquid absorbing member 50 is white, and the marker 50*d* is black). The liquid absorbing member 50 is, for example, a reflection photosensor. The position of the marker 50*d* is not necessarily on the reverse surface 50*b* but may be on, for example, the obverse surface 50*a*. It is possible, however, to avoid contact between the ink image IM and the marker 50*d* by providing it on the reverse surface 50*b*.

Figure 9B:
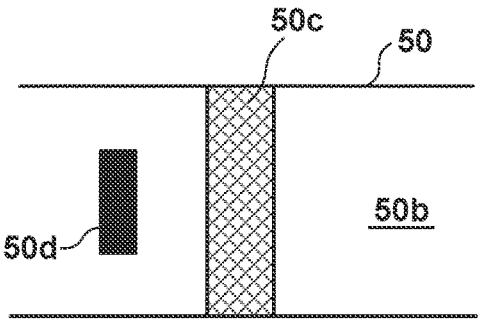

In this embodiment, the marker 50*d* is formed on the connecting portion 50*c*. However, the marker 50*d* may be formed, for example, at a position away from the connecting portion 50*c* as shown in FIG. 9B as long as a predetermined positional relationship with the connecting portion 50*c* is known.

Figure 10A:
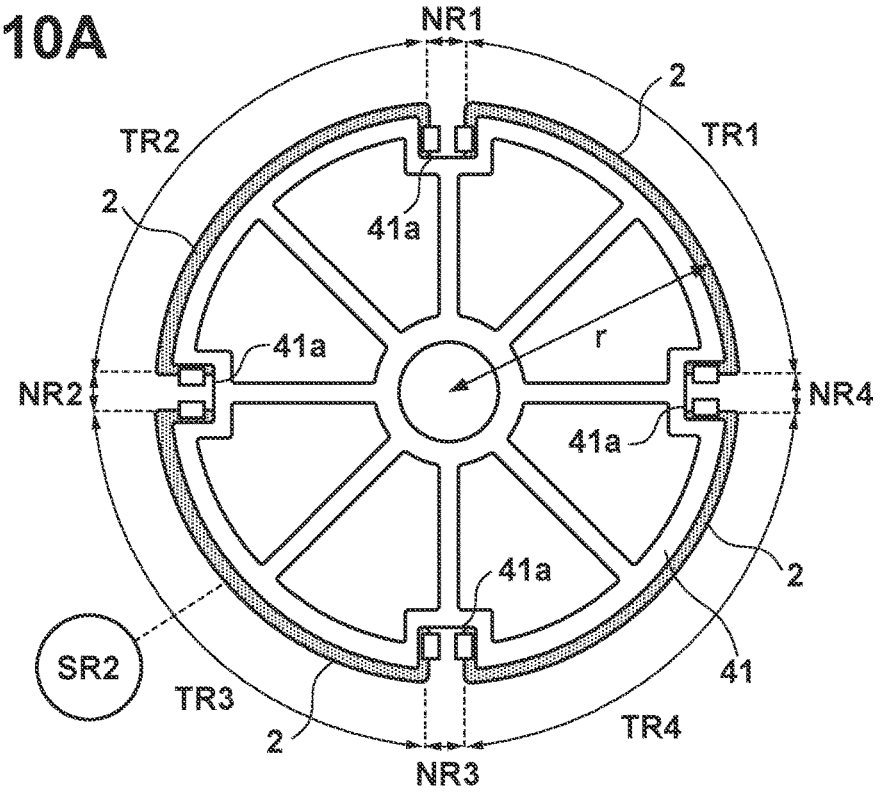
FIGS. 10A and 10B are views each showing an example of the arrangement of a transfer drum and transfer members.

The connecting portion 50*c* may differ from the other portion of the liquid absorbing member 50 in characteristic of a liquid absorbing surface (obverse surface 50*a*). If the connecting portion 50*c* contacts the ink image IM, liquid absorbing performance may be poor (degraded) as compared to the other portion. Moreover, if the connecting portion 50*c* and its other portion contact the ink image IM simultaneously, a portion having a different amount of a remaining liquid component in the ink image IM may be generated. To prevent this, in this embodiment, a transfer section and a non-transfer section are provided on the side of the transfer member 2, preventing the connecting portion 50*c* from contacting and facing the transfer section at the liquid absorbing position NP. FIG. 10A shows an example of the arrangement of the transfer drum 41 and the transfer members 2.

The transfer drum 41 in the example of FIG. 10A has a columnar outer peripheral surface, and concave portions 41*a* are formed at an equal angular pitch (90°-pitch in the example of FIG. 10A) about a rotation axis. Each concave portion 41*a* is a space where a gripper that grips the end of the transfer member 2 is arranged. In the example of FIG. 10A, four transfer members 2 (in other words, four segments) are held on the outer peripheral surface of the transfer drum 41 intermittently in a circumferential direction. In this arrangement, surface regions of the four transfer members 2 form transfer sections TR1 to TR4. The ink image IM is formed on each transfer section. Each of the transfer sections TR1 to TR4 corresponds to one print medium P. In other words, an arrangement capable of transferring the ink images IM to a maximum of four print media P in on rotation of the transfer drum 41 is adopted.

Non-transfer sections NR1 to NR4 are formed between the adjacent transfer sections. The non-transfer sections NR1 to NR4 are regions on the concave portions 41*a* and gaps between the adjacent transfer sections. The non-transfer sections NR1 to NR4 are regions where the ink images IM are not formed. By rotating the transfer drum 41, the transfer sections and the non-transfer sections are moved to the liquid absorbing position NP cyclically in the order of the transfer section TR1, the non-transfer section NR1, the transfer section TR2, the non-transfer section NR2 . . . .

A sensor SR2 is a sensor that detects the rotation amount of the transfer drum 41 and is, for example, a rotary encoder. The sensor SR2 can detect the phase of the transfer drum 41, recognizing the positions of each transfer section and non-transfer section. Consequently, a timing at which each transfer section or non-transfer section passes through the liquid absorbing position NP is recognized.

Figure 10B:
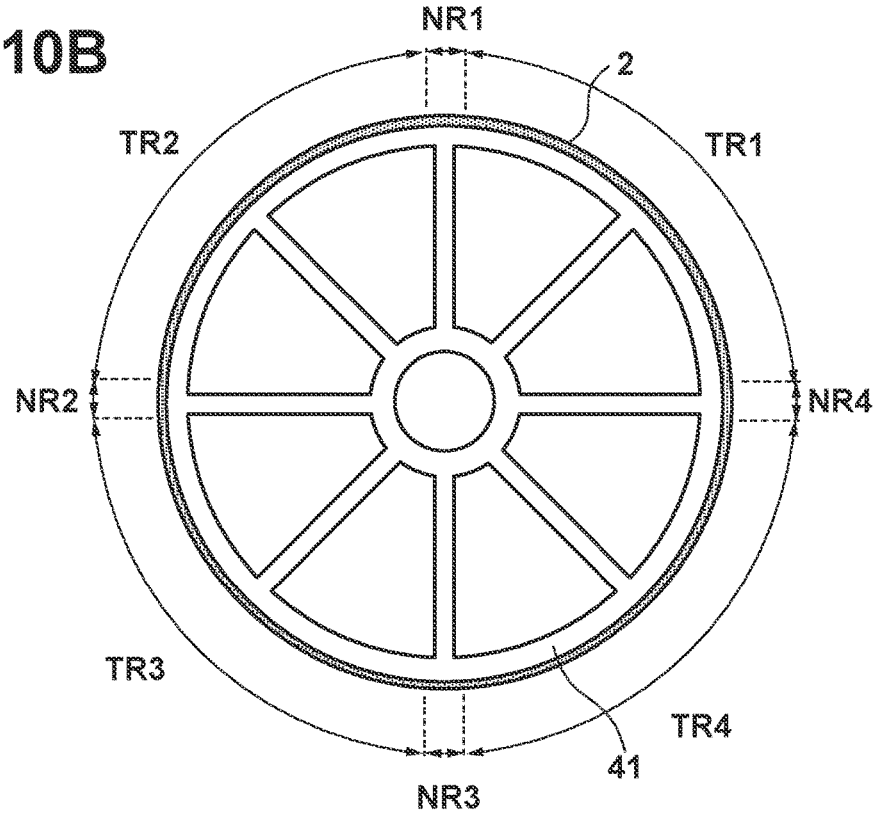

Note that in the example of FIG. 10A, portions other than points where the transfer members 2 are installed serve as the non-transfer sections. However, parts of the transfer member 2 may be used as the non-transfer sections. FIG. 10B shows an example of this. In the example of FIG. 10B, the transfer member 2 is provided on the outer peripheral surface of the transfer drum 41 over an entire circumference continuously in the circumferential direction. It is therefore possible to use the entire outer periphery of the transfer drum 41 as the transfer sections. As in the example of FIG. 10B, however, it may be used not as the transfer sections but as the non-transfer sections NR1 to NR4.

<Position Control of Connecting Portion>

In order to avoid the connecting portion 50*c* from contacting the ink image IM, in this embodiment, driving of the motor M is controlled such that the connecting portion 50*c* also passes through the liquid absorbing position NP while the non-transfer sections NR1 to NR4 pass through the liquid absorbing position NP. Based on a detection result of the sensor SR1, the transfer control unit 15B controls the motor M. Based on detection results of the detection unit 52 and the sensor SR2, the transfer control unit 15B increases/decreases the running velocity of the liquid absorbing member 50 so as to synchronize the timing at which the connecting portion 50*c* passes through the liquid absorbing position NP with a pass timing of one of the non-transfer sections NR1 to NR 4. This makes it possible to avoid the connecting portion 50*c* from contacting the ink image IM. However, the liquid absorbing member 50 may scrape a coloring material of the ink image IM if a velocity difference between a peripheral velocity on the surface of the transfer member 2 and the running velocity of the liquid absorbing member 50 is large.

To cope with this, a method below makes the liquid absorbing member 50 less scrape the coloring material of the ink image IM. In this embodiment, the transfer drum 41 is assumed to rotate at a constant velocity. That is, the peripheral velocity on the surface of the transfer member 2 is constant. The running velocity of the liquid absorbing member 50 is basically controlled at an equal velocity to the peripheral velocity on the surface of the transfer member 2. In this premise, avoidance of contact between the connecting portion 50*c* and the ink image IM uses both a structural approach and a control approach. The structural approach will be described first.

Figure 9C:
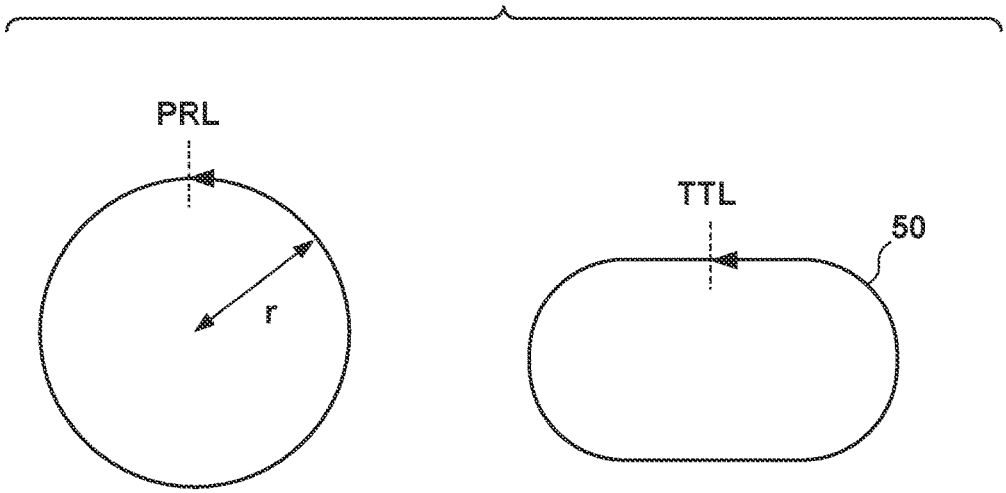
FIG. 9C shows explanatory views of peripheral lengths.

The peripheral length of the liquid absorbing member 50 is an integer multiple of a peripheral length on the surface of the transfer member 2. FIG. 9C is an explanatory view of this. A peripheral length PRL is a peripheral length of a virtual circle having a radius r (see FIG. 10A) from the rotation center of the transfer drum 41 to the surface of the transfer member 2. A peripheral length TTL is a peripheral length of the obverse surface 50*a* of the liquid absorbing member 50. If the peripheral length TTL=integer×peripheral length PRL, a portion on the side of the transfer member 2 facing the connecting portion 50*c* is always the same. That is, at the time of initial setting, the position of the liquid absorbing member 50 in the running direction is set such that one of the non-transfer sections NR1 to NR4 (for example, NR1 here) and the connecting portion 50*c* face each other at the liquid absorbing position NP. Consequently, when the connecting portion 50*c* reaches the liquid absorbing position NP, the non-transfer section NR1 also reaches the liquid absorbing position NP simultaneously. It is therefore possible to avoid the contact between the connecting portion 50*c* and the ink image IM.

However, this positional relationship may be shifted by shifting the position of the liquid absorbing member 50 in the running direction or extending the liquid absorbing member 50 as the operation of the absorption unit 5B progresses. To cope with this, this shift in positional relationship is absorbed by the control approach (velocity correction control) of changing the running velocity of the liquid absorbing member 50 temporarily.

Velocity Correction Example

Figure 11:
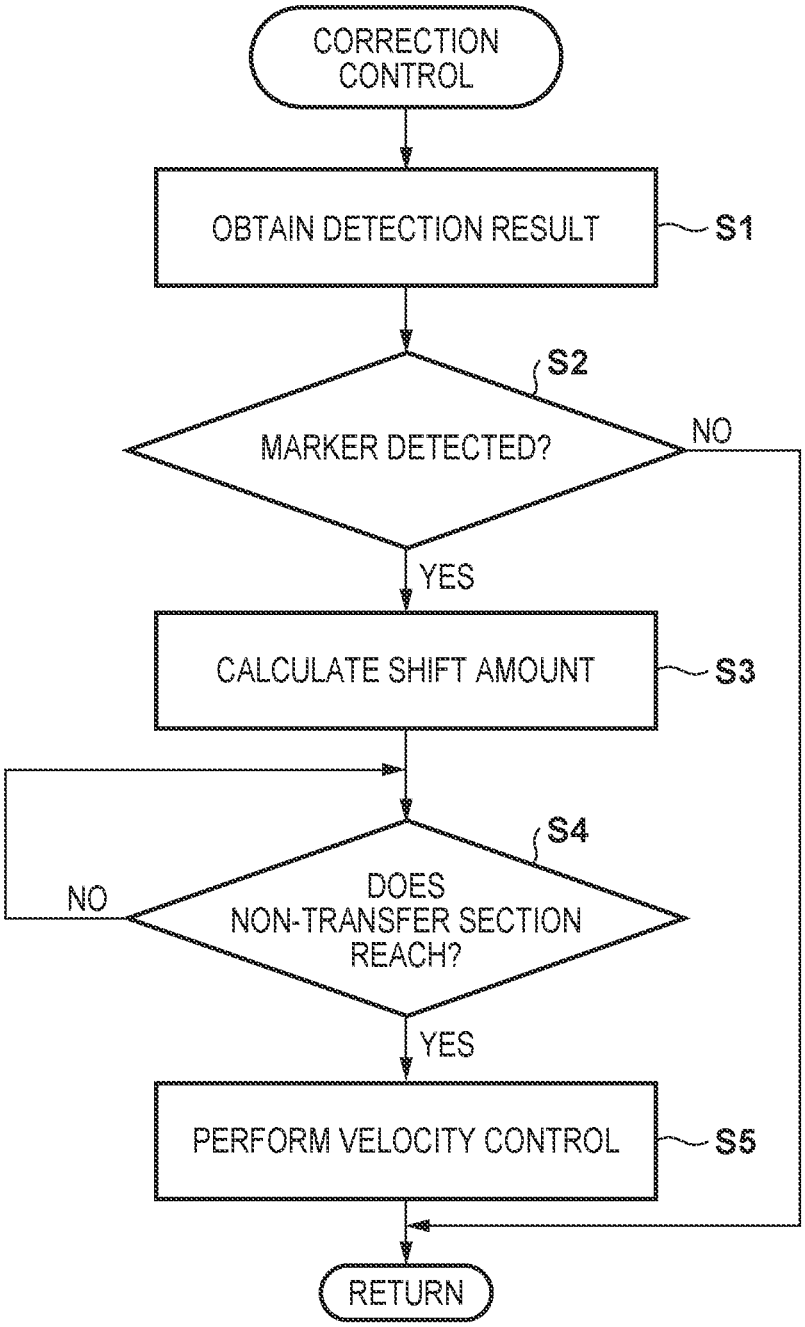
FIG. 11 is a flowchart showing an example of control of the absorption unit.

FIG. 11 is a flowchart showing an example of a process performed by the transfer control unit 15B. In step S1, the transfer control unit 15B obtains a detection result of the detection unit 52. In step S2, the transfer control unit 15B determines whether the marker 50*d* is detected in the detection result in step S1. If the marker 50*d* is detected, the process advances to step S3. If the marker 50*d* is not detected, the process ends.

Figure 12:
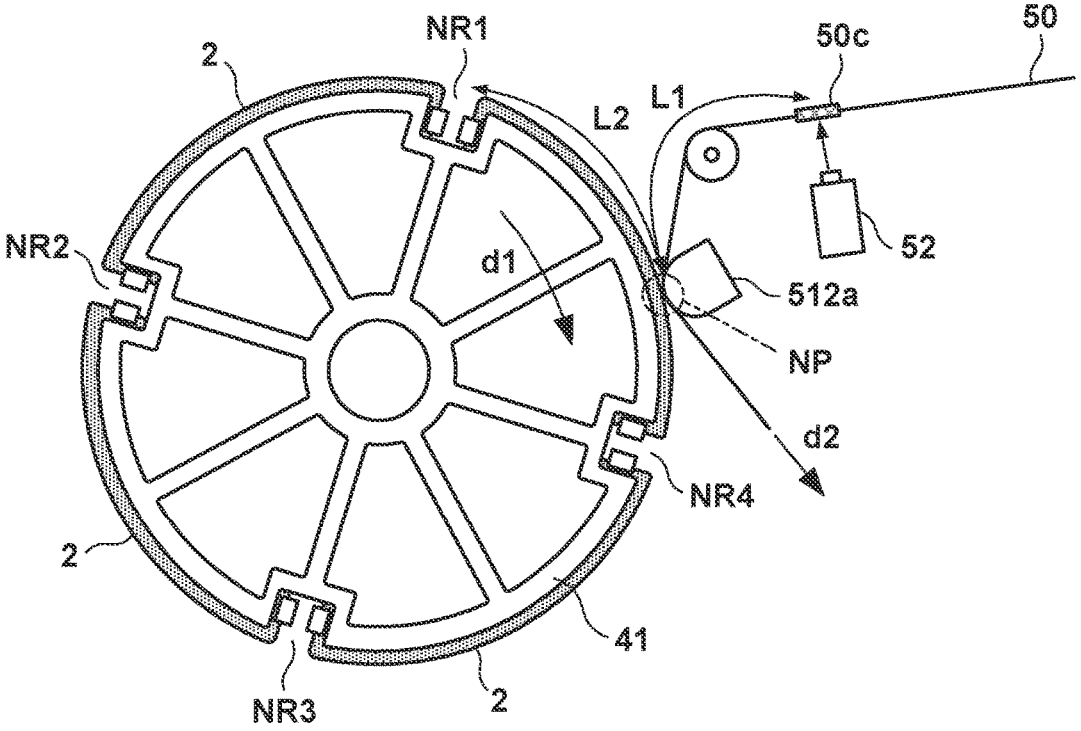
FIG. 12 is a view showing an example of control of the absorption unit.

In step S3, the transfer control unit 15B calculates a shift amount between the non-transfer section NR1 and the connecting portion 50*c*. The shift amount will be described with reference to FIG. 12. FIG. 12 shows a stage in which the detection unit 52 detects the marker 50*d*. A length L1 of the liquid absorbing member 50 from a detection position of the detection unit 52 to the liquid absorbing position NP is known as a design value. It is therefore possible to calculate a timing at which the connecting portion 50*c* reaches the liquid absorbing position NP from the running velocity of the liquid absorbing member 50. The position (phase) of the non-transfer section NR1 can be recognized from the detection result of the sensor SR2. It is also possible to calculate a timing at which the non-transfer section NR1 reaches the liquid absorbing position NP from the rotation velocity of the transfer drum 41.

Figure 13:
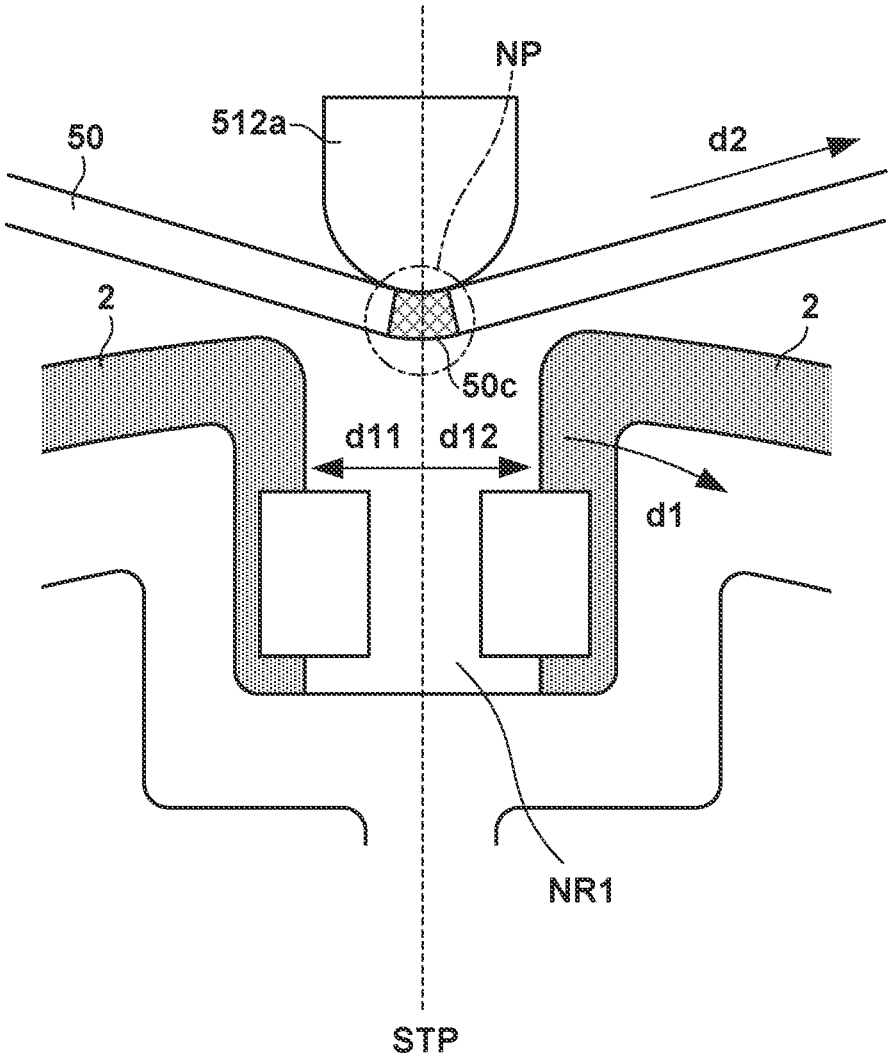
FIG. 13 is a view showing an example of a positional relationship between a connecting portion and a non-transfer section at a liquid absorbing position.

FIG. 13 schematically shows a state in which the non-transfer section NR1 and the connecting portion 50*c* reach the liquid absorbing position NP without any shift. When the center of the non-transfer section NR1 in the circumferential direction reaches a reference position STP, the transfer control unit 15B calculates in step S3 the amount with respect to the reference position STP by which the center of the connecting portion 50*c* in the running direction shifts. If the transfer control unit 15B calculates that the connecting portion 50*c* shifts in the direction of an arrow d11, the liquid absorbing member 50 needs to speed up temporarily. Conversely, if the transfer control unit 15B calculates that the connecting portion 50*c* shifts in the direction of an arrow d12, the liquid absorbing member 50 needs to slow down temporarily.

The velocity of the liquid absorbing member 50 is adjusted while one of the non-transfer sections NR1 to NR4 passes through the liquid absorbing position NP. The adjustment is exemplarily performed here while the non-transfer section NR1 passes through the liquid absorbing position NP. Referring back to FIG. 11, based on the detection result of the sensor SR2, the transfer control unit 15B determines in step S4 whether the non-transfer section NR1 reaches the liquid absorbing position NP. If the non-transfer section NR1 has not reached yet, the transfer control unit 15B waits until the non-transfer section NR1 reaches. If the non-transfer section NR1 has reached, the process advances to step S5 in which the transfer control unit 15B performs velocity control.

Figure 14:
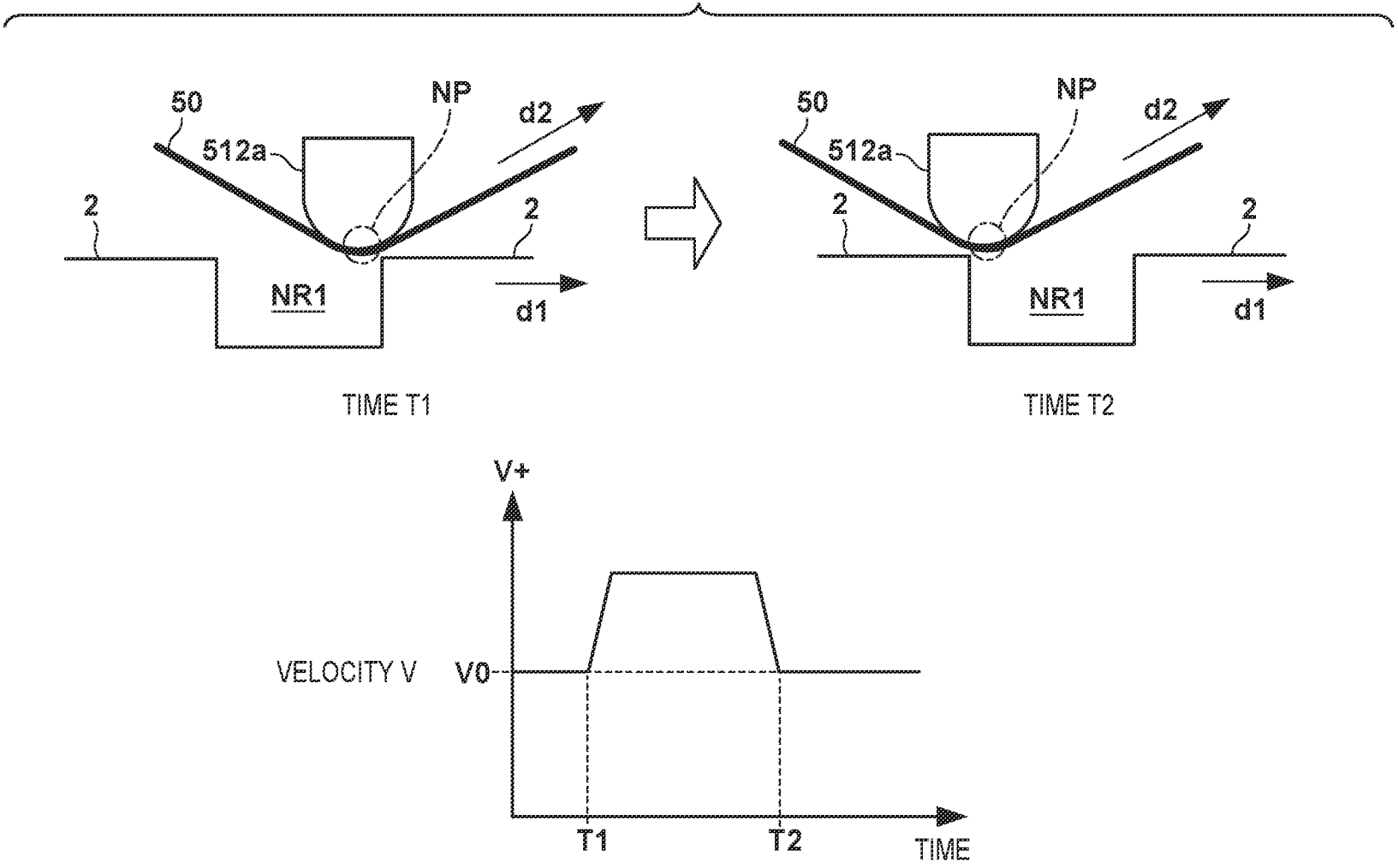
FIG. 14 shows views and a chart for explaining an example of velocity control of the liquid absorbing member.
Figure 15:
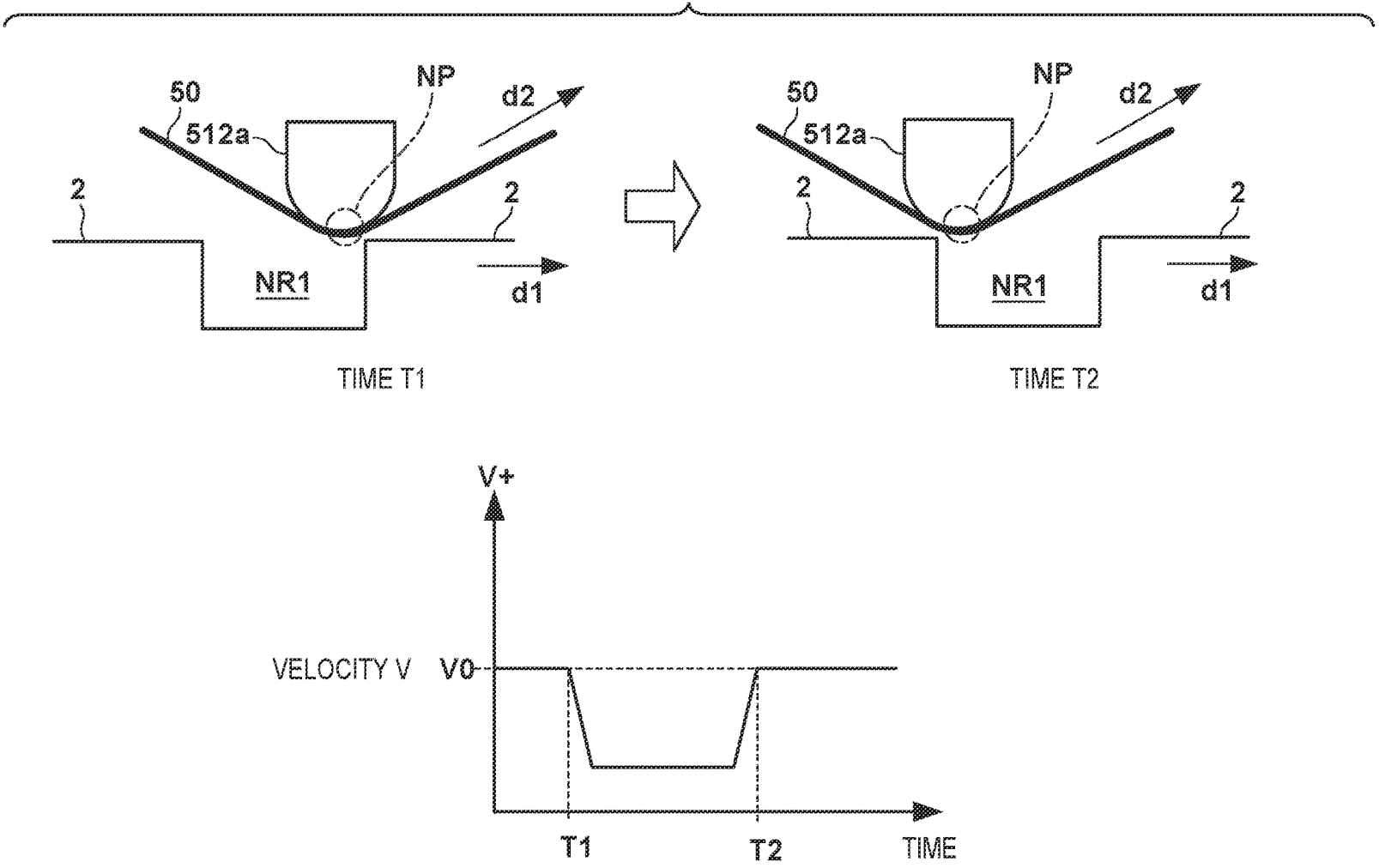
FIG. 15 shows views and a chart for explaining an example of the velocity control of the liquid absorbing member.

Each of FIGS. 14 and 15 exemplifies an example of the velocity control in step S5. FIG. 14 shows the example of a temporary speedup. Between times T1 and T2, the non-transfer section NR1 passes through the liquid absorbing position NP. An end on a leading side reaches the liquid absorbing position NP in a moving direction of the non-transfer section NR1, and an end on a trailing side in the moving direction of the non-transfer section NR1 is about to pass through the liquid absorbing position NP at the time T2.

A running velocity V of the liquid absorbing member 50 starts to increase from a constant velocity V0 at the time T1 and changes to a velocity higher than the constant velocity V0. Subsequently, the velocity is decreased back to the constant velocity V0 by the time T2. While the running velocity V changes, the liquid absorbing member 50 faces none of the transfer sections TR1 to TR4 at the liquid absorbing position NP, and thus does not contact the ink image IM.

FIG. 15 shows the example of a temporary slowdown. As in the example of FIG. 14, the non-transfer section NR1 passes through the liquid absorbing position NP between the times T1 and T2. The running velocity V of the liquid absorbing member 50 starts to decrease from the constant velocity V0 at the time T1 and changes to a velocity lower than the constant velocity V0. Subsequently, the velocity is increased back to the constant velocity V0 by the time T2. While the running velocity V changes, the liquid absorbing member 50 faces none of the transfer sections TR1 to TR4 at the liquid absorbing position NP, and thus does not contact the ink image IM. In each example of FIGS. 14 and 15, a velocity adjustment amount may be calculated each time based on a calculation result of the shift amount in step S3 of FIG. 11, or a fixed value for a speedup and a fixed value for a slowdown may be set in advance and fixed.

With above control, the position of the connecting portion 50*c* is maintained appropriately with respect to the reference position STP described in FIG. 13, making it possible to avoid the connecting portion 50*c* from contacting the ink image IM. If the example of the process in FIG. 11 is performed in an example of FIG. 12, the velocity control in step S5 is performed at a timing when both the connecting portion 50*c* and the non-transfer section NR1 pass through the liquid absorbing position NP. The timing for the velocity control in step S5 is not limited to this. It is possible, however, to perform the avoidance of the contact between the connecting portion 50*c* and the ink image IM, and relative position adjustment of the connecting portion 50*c* to the reference position STP simultaneously.

Note that velocity adjustment may be performed at respective timings when the plurality of non-transfer sections pass through the liquid absorbing position NP during one rotation of the transfer drum 41, for example, velocity adjustment performed at four timings when the non-transfer sections NR1 to NR4 pass through the liquid absorbing position NP.

Another Velocity Correction Example

In each example of FIGS. 11 and 14 to 15, the velocity of the liquid absorbing member 50 is increased/decreased back to the original constant velocity V0 while one non-transfer section passes through the liquid absorbing position NP. The relative position adjustment amount of the connecting portion 50*c* to the reference position STP is limited because of a structure if a time in which the non-transfer section passes through the liquid absorbing position NP is short. To cope with this, one of an increase and decrease in velocity of the liquid absorbing member 50 may be performed while one non-transfer section passes through the liquid absorbing position NP, and then the other of the increase and decrease in velocity of the liquid absorbing member 50 may be performed while the same or different non-transfer section passes through the liquid absorbing position NP. In this case, a velocity difference occurs between the peripheral velocity on the surface of the transfer member 2 and the running velocity of the liquid absorbing member 50. It is possible, however, to make the liquid absorbing member 50 less scrape the coloring material of the ink image IM by suppressing this difference small.

Figure 16:
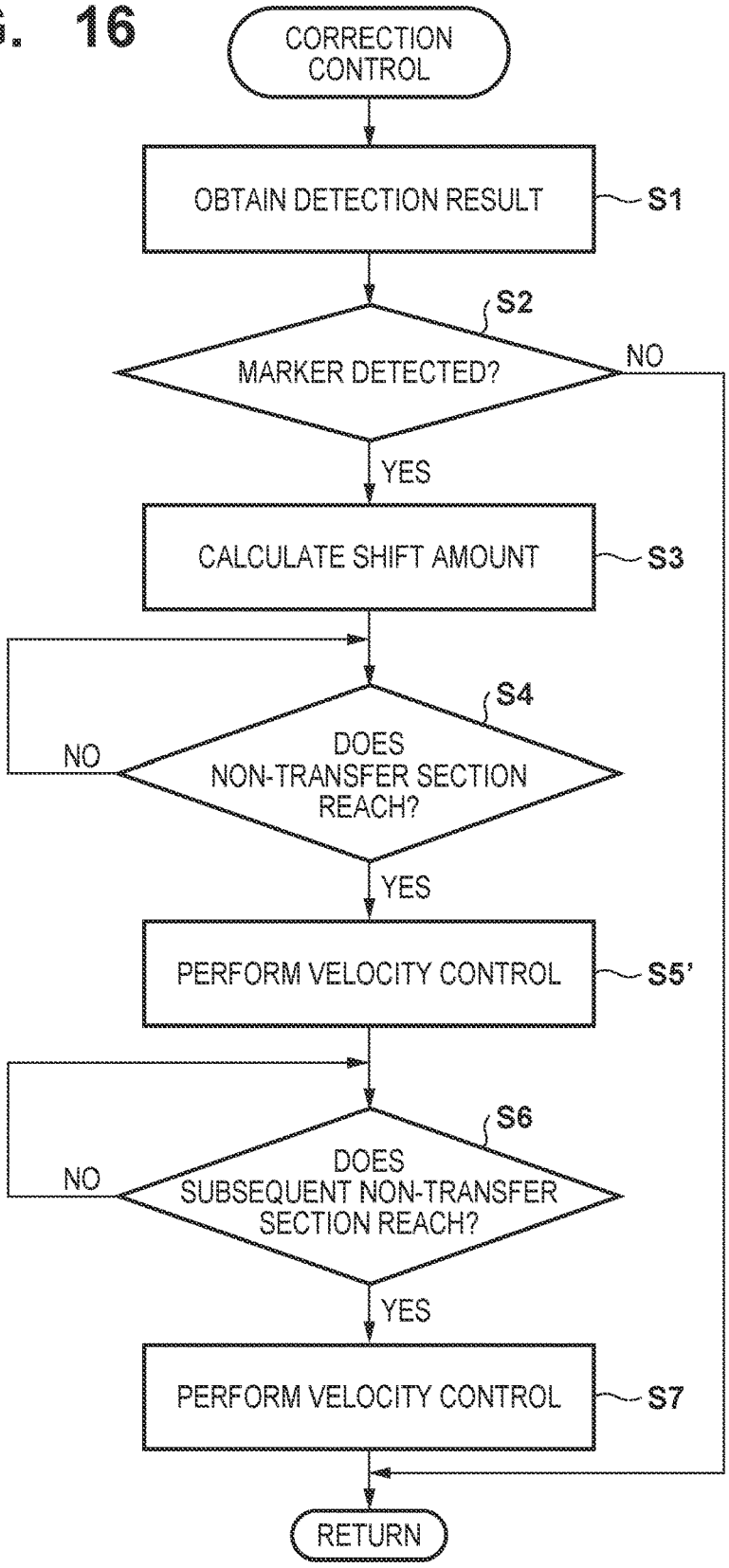
FIG. 16 is a flowchart showing an example of another control of the absorption unit.

FIG. 16 is a flowchart showing an example of a process performed by the transfer control unit 15B. Processes in steps S1 to S4 are the same as those in FIG. 11. Velocity control is performed in step S5'.

Figure 17:
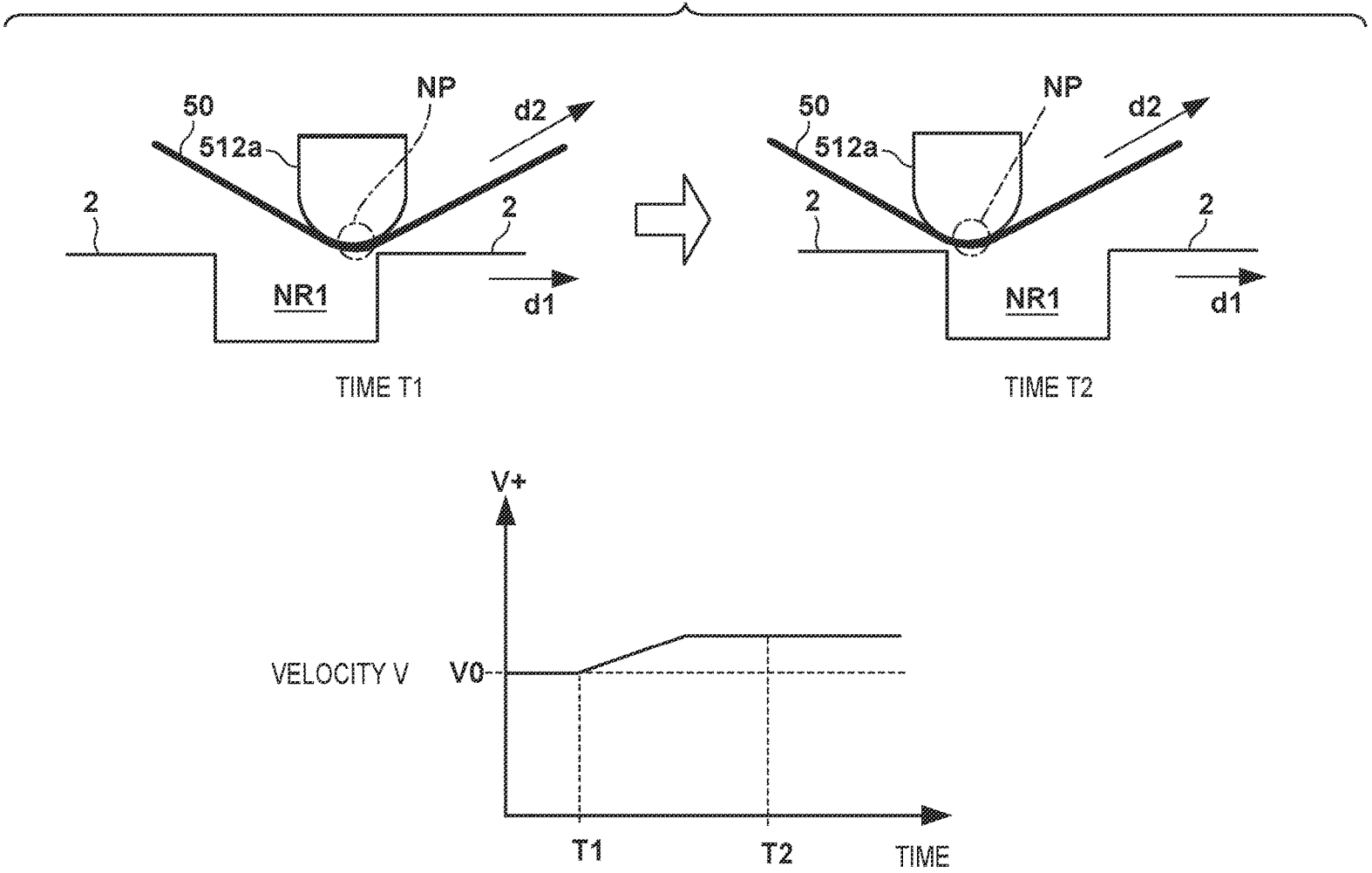
FIG. 17 shows views and a chart for explaining still another example of velocity control of the liquid absorbing member.

FIG. 17 exemplifies an example of the velocity control in step S5' and shows an example of a temporary speedup. The non-transfer section NR1 passes through the liquid absorbing position NP between the times T1 and T2. The running velocity V of the liquid absorbing member 50 starts to increase from the constant velocity V0 at the time T1 and changes to a velocity higher than the constant velocity V0. Subsequently, the velocity is not decreased by the time T2, and a constant velocity higher than the constant velocity V0 is maintained. That is, the velocity is only increased and is not returned to the constant velocity V0 in this period.

Referring back to FIG. 16, based on a detection result of the sensor SR2, the transfer control unit 15B determines in step S6 whether the non-transfer section (for example, the non-transfer section NR2 here) subsequent to the non-transfer section NR1 reaches the liquid absorbing position NP. If the non-transfer section has not reached yet, the transfer control unit 15B waits until the non-transfer section reaches. If the non-transfer section has reached, the process advances to step S7 in which the transfer control unit 15B performs velocity control.

Figure 18:
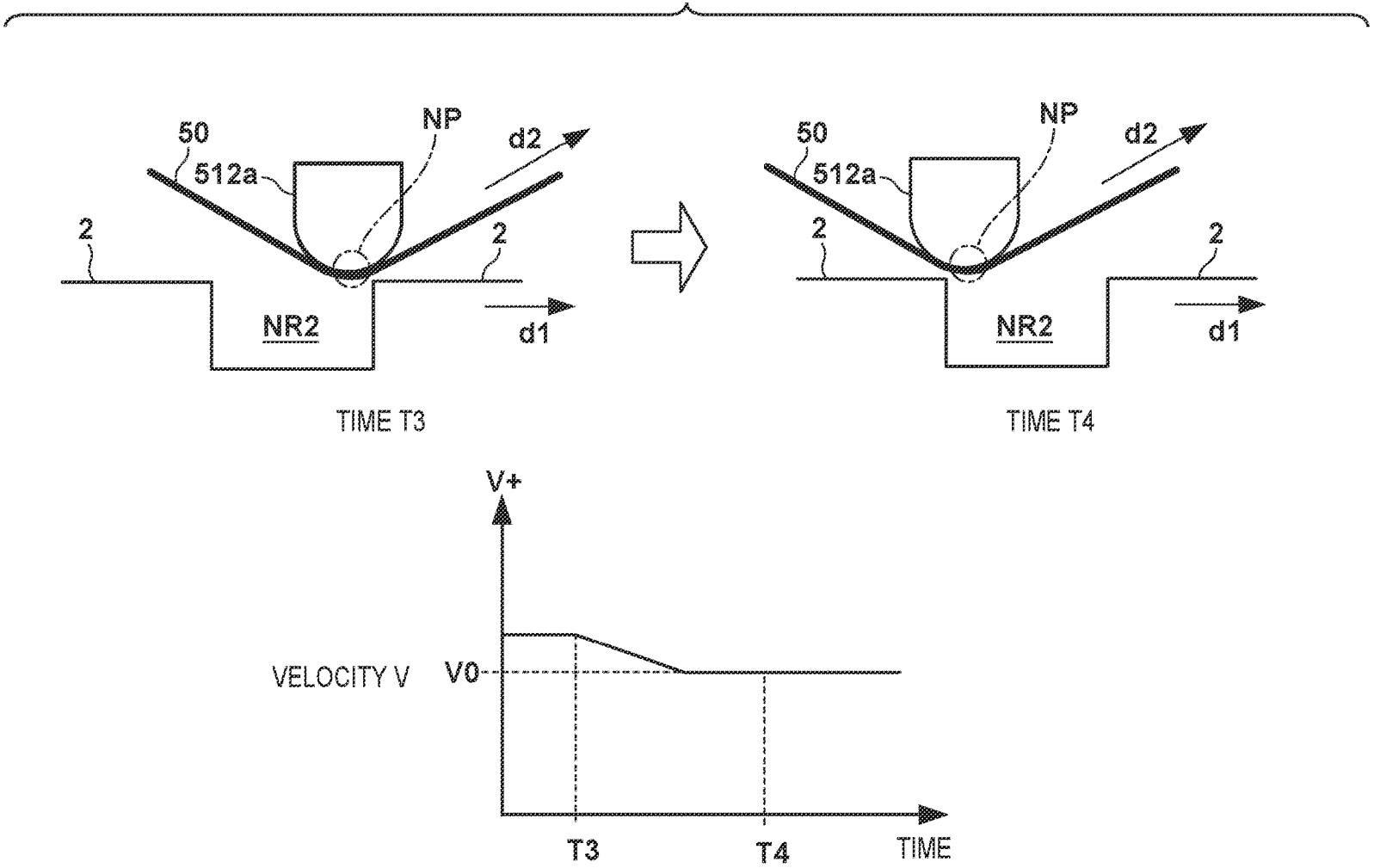
FIG. 18 shows views and a chart for explaining yet another example of the velocity control of the liquid absorbing member.

FIG. 18 exemplifies an example of the velocity control in step S7. The non-transfer section NR2 passes through the liquid absorbing position NP between times T3 and T4. The running velocity V of the liquid absorbing member 50 starts to decrease at the time T3 and is returned to the constant velocity V0 by the time T4. That is, only a slowdown is performed in this period, returning the running velocity V to the constant velocity V0. Between the time T2 and the time T3, a velocity difference occurs between the peripheral velocity on the surface of the transfer member 2 and the running velocity of the liquid absorbing member 50. It is possible, however, to make the liquid absorbing member 50 less scrape the coloring material of the ink image IM by suppressing this difference small. The liquid absorbing member 50 does not contact the ink image IM while increasing/decreasing the velocity when an influence by scraping is obtained comparatively easily. The degree of velocity can be set appropriately in consideration of a balance with image quality. Each of FIGS. 17 and 18 shows the example of the temporary speedup. However, the same also applies to a case of the temporary slowdown.

Another Arrangement Example of Absorption Unit

Figure 19:
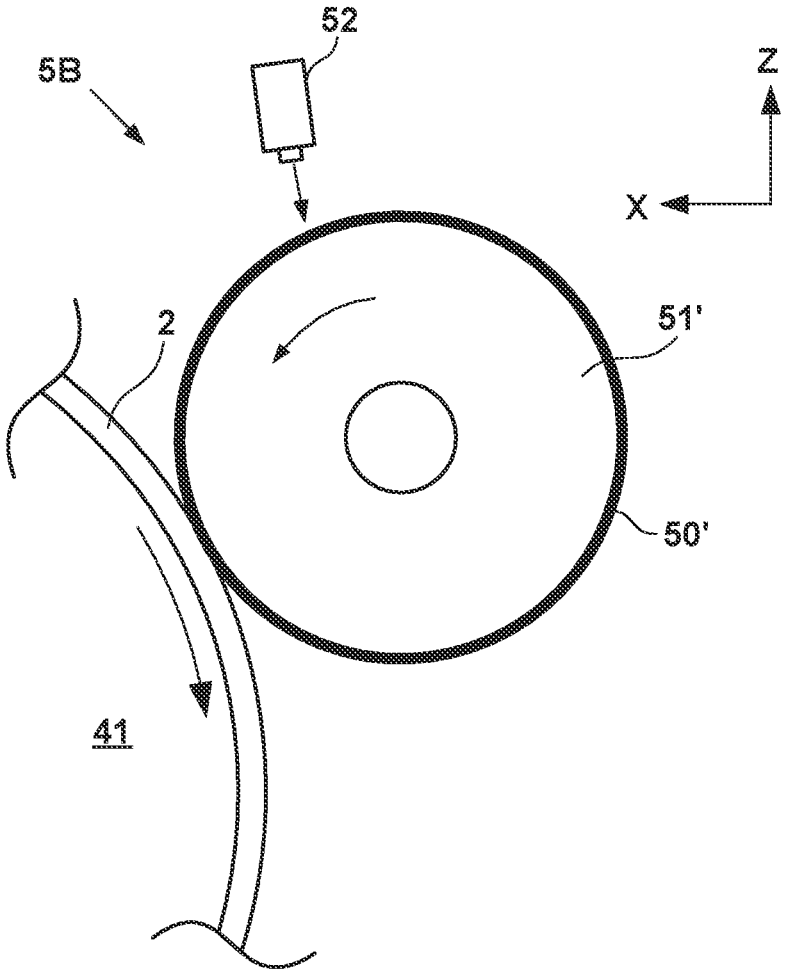
FIG. 19 is a schematic view showing another example of the absorption unit.

In the above-described embodiment, the liquid absorbing member 50 is formed into an endless swath and configured to run cyclically. However, another configuration can also be adopted. FIG. 19 shows an example of this. In the example of FIG. 19, a driving unit 51' includes a rotating body such as a roller that can rotate about an axis in the Y direction, and a liquid absorbing member 50' is disposed on its peripheral surface. The liquid absorbing member 50' moves cyclically by rotating the rotating body. The detection unit 52 is arranged in the middle of a moving path of the liquid absorbing member 50' and detects a marker (not shown) on the liquid absorbing member 50'.

In the above-described embodiment, the connecting portion 50*c* is exemplified as a predetermined portion of the liquid absorbing member 50 that should avoid contacting the ink image IM. However, the present invention is not limited to this. The portion may be, for example, a rough portion caused by a manufacturing error, a deteriorated portion or dirty portion caused by use, or the like on the liquid absorbing member 50. In the embodiment in which the marker 50*d* is used, it is also possible to recognize a portion generated later as a portion that should avoid contacting the ink image IM by providing the marker 50*d* in a target portion.

In the above-described embodiment, one detection unit 52 is provided. However, the plurality of detection units 52 may be provided on the moving path of the liquid absorbing member 50. Then, based on detection results of the respective detection units 52, velocity adjustment may be performed a plurality of times in one round of the liquid absorbing member 50.

Another Embodiment of System

In the above embodiment, the print unit 3 includes the plurality of printheads 30. However, a print unit 3 may include one printhead 30. The printhead 30 may not be a full-line head but may be of a serial type that forms an ink image by discharging ink from the printhead 30 while a carriage that mounts the printhead 30 detachably moves in a Y direction.

A conveyance mechanism of a print medium P may adopt another method such as a method of clipping and conveying the print medium P by a pair of rollers. In the method of conveying the print medium P by the pair of rollers or the like, a roll sheet may be used as the print medium P, and a printed product P' may be formed by cutting the roll sheet after transfer.

In the above embodiment, the transfer member 2 is provided on the outer peripheral surface of the transfer drum 41. However, another method such as a method of forming a transfer member 2 into an endless swath and running it cyclically may be used.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2017-047490, filed Mar. 13, 2017, which is hereby incorporated by reference herein in its entirety.

What is claimed is:

1. A printing apparatus comprising:

a transfer drum that includes a transfer section and a non-transfer section which are moved cyclically;

a print unit configured to form an ink image by discharging ink to the transfer section;

a transfer unit configured to perform a transfer operation of transferring the ink image formed on the transfer section to a print medium;

a liquid absorbing member configured to absorb a liquid component from the ink image on the transfer section before the transfer operation is performed;

a driving unit configured to move the liquid absorbing member; and a control unit configured to control the driving unit such that, when a position at which the liquid absorbing member absorbs the liquid component from the ink image on the transfer section is defined as a liquid absorbing position, a predetermined portion in which liquid absorbing performance of the liquid absorbing member degrades passes through the liquid absorbing position while the non-transfer section passes through the liquid absorbing position.

2. The apparatus according to claim 1, wherein the control unit makes the predetermined portion pass through the liquid absorbing position while the non-transfer section passes through the liquid absorbing position by adjusting a moving velocity of the liquid absorbing member.

3. The apparatus according to claim 2, wherein the control unit adjusts the moving velocity of the liquid absorbing member while the non-transfer section passes through the liquid absorbing position.

4. The apparatus according to claim 2, wherein the control unit moves the liquid absorbing member at a constant velocity while the transfer section passes through the liquid absorbing position and adjusts the moving velocity of the liquid absorbing member while the non-transfer section passes through the liquid absorbing position.

5. The apparatus according to claim 2, wherein the control unit moves the liquid absorbing member at a constant velocity while the transfer section passes through the liquid absorbing position, performs one of a speedup or a slowdown of the liquid absorbing member in a first period during which the non-transfer section passes through the liquid absorbing position, and performs the other of the speedup or the slowdown of the liquid absorbing member in a second period during which the non-transfer section passes through the liquid absorbing position after the first period.

6. The apparatus according to claim 1, wherein the predetermined portion is a connecting portion of the liquid absorbing member.

7. The apparatus according to claim 1, wherein the liquid absorbing member is an endless belt, and the predetermined portion is a connecting portion of a belt material for the endless belt.

8. The apparatus according to claim 1, wherein the transfer section is formed by a plurality of transfer members which are supported intermittently in a circumferential direction on a peripheral surface of the transfer drum rotated at a constant velocity, and the non-transfer section is formed by a gap between the adjacent transfer members.

9. The apparatus according to claim 1, wherein the transfer section is formed in a partial region of a transfer member supported on a peripheral surface of the transfer drum, and the non-transfer section is formed in another partial region of the transfer member.

10. The apparatus according to claim 1, wherein the transfer section and the non-transfer section are formed on a peripheral surface of the transfer drum, a marker indicating a position of the predetermined portion is formed in the liquid absorbing member;

the apparatus further comprises a detection unit configured to detect the marker at a predetermined position on a moving path of the liquid absorbing member, and the control unit controls the driving unit based on a rotation phase of the transfer drum and a detection result of the detection unit.

11. The apparatus according to claim 1, wherein the transfer section and the non-transfer section are formed on a peripheral surface of the transfer drum, the liquid absorbing member is an endless belt, and a peripheral length of the endless belt is an integer multiple of a peripheral length of a virtual circle having a radius from a rotation center of the transfer drum to a surface of the transfer member.

12. The apparatus according to claim 11, wherein the control unit controls a running velocity of the endless belt at an equal velocity to a peripheral velocity on the surface of the transfer member while the transfer section passes through the liquid absorbing position and makes the predetermined portion pass through the liquid absorbing position by adjusting a running velocity of the endless belt while the non-transfer section passes through the liquid absorbing position.

13. A liquid absorbing apparatus comprising:

a liquid absorbing member configured to absorb a liquid component from an ink image formed on a transfer section of the transfer section and a non-transfer section moved cyclically before the ink image is transferred to a print medium;

a driving unit configured to move the liquid absorbing member; and a control unit configured to control the driving unit such that, when a position at which the liquid absorbing member absorbs the liquid component from the ink image on the transfer section is defined as a liquid absorbing position, a predetermined portion in which liquid absorbing performance of the liquid absorbing member degrades passes through the liquid absorbing position while the non-transfer section passes through the liquid absorbing position.

14. A method of manufacturing a printed product by transferring an ink image to a print medium via a transfer section of the transfer section and a non-transfer section moved cyclically, the method comprising:

forming an ink image to the transfer section by discharging ink to the transfer section;

absorbing a liquid component from the ink image on the transfer section after the forming; and transferring the ink image from the transfer section to the print medium after the absorbing, wherein the absorbing includes moving a liquid absorbing member so as to pass through a liquid absorbing position at which the liquid component is absorbed from the ink image on the transfer section, and controlling a movement of the liquid absorbing member such that a predetermined portion in which liquid absorbing performance of the liquid absorbing member degrades passes through the liquid absorbing position while the non-transfer section passes through the liquid absorbing position.

* * * * *